US006427608B1

(12) United States Patent
Crinion

(10) Patent No.: US 6,427,608 B1
(45) Date of Patent: Aug. 6, 2002

(54) COUNTERLINE SYSTEMS

(75) Inventor: Jonathan Crinion, Toronto (CA)

(73) Assignee: Teknion Furniture Systems Limited, Toronto (CA)

( * ) Notice: Subject to any disclaimer, the term of this patent is extended or adjusted under 35 U.S.C. 154(b) by 0 days.

(21) Appl. No.: 08/560,675

(22) Filed: Nov. 20, 1995

Related U.S. Application Data

(63) Continuation of application No. 08/261,089, filed on Jun. 15, 1994, now Pat. No. 5,467,703, which is a continuation of application No. 07/796,788, filed on Nov. 25, 1991, now abandoned.

(51) Int. Cl.[7] ..... A47B 37/00
(52) U.S. Cl. ..... 108/50.02
(58) Field of Search ..... 108/50.01, 64, 108/23; 312/50.02, 223.6, 223.1, 195

(56) References Cited

U.S. PATENT DOCUMENTS 1,786,823 A * 12/1930 Carrington et al. .. 312/223.6 X
4,066,305 A * 1/1978 Gazarek ..... 312/223.6 X
4,094,561 A * 6/1978 Wolff et al. ..... 312/223.6
4,243,279 A * 1/1981 Ackeret ..... 108/64 X
4,838,177 A * 6/1989 Vander Park ..... 108/50 X
5,103,741 A * 4/1992 Grund et al. ..... 108/50
5,130,494 A * 7/1992 Simonton et al. ..... 108/50 X
5,237,935 A * 8/1993 Newhouse et al. ..... 108/50
5,272,988 A * 12/1993 Kelley et al. ..... 108/50
5,467,703 A * 11/1995 Crinion ..... 108/50
5,473,994 A * 12/1995 Foley et al. ..... 108/50

FOREIGN PATENT DOCUMENTS

EP 10301 * 4/1980 ..... 312/223.6

* cited by examiner

*Primary Examiner*—Jose V. Chen
(74) *Attorney, Agent, or Firm*—Bereskin & Parr

(57) ABSTRACT

A modular counterline system disclosed which uses separate sections which can be offset, one from the other, to provide flexibility for initial design requirements as well as for changing the layout as the user's needs change. The system also accommodates the convenient capability to allow wires and the like to be added into a raceway or passageway without threading through ports. The system also uses opposed side frames between sections for partially defining the passageway.

11 Claims, 9 Drawing Sheets

FIG.10.
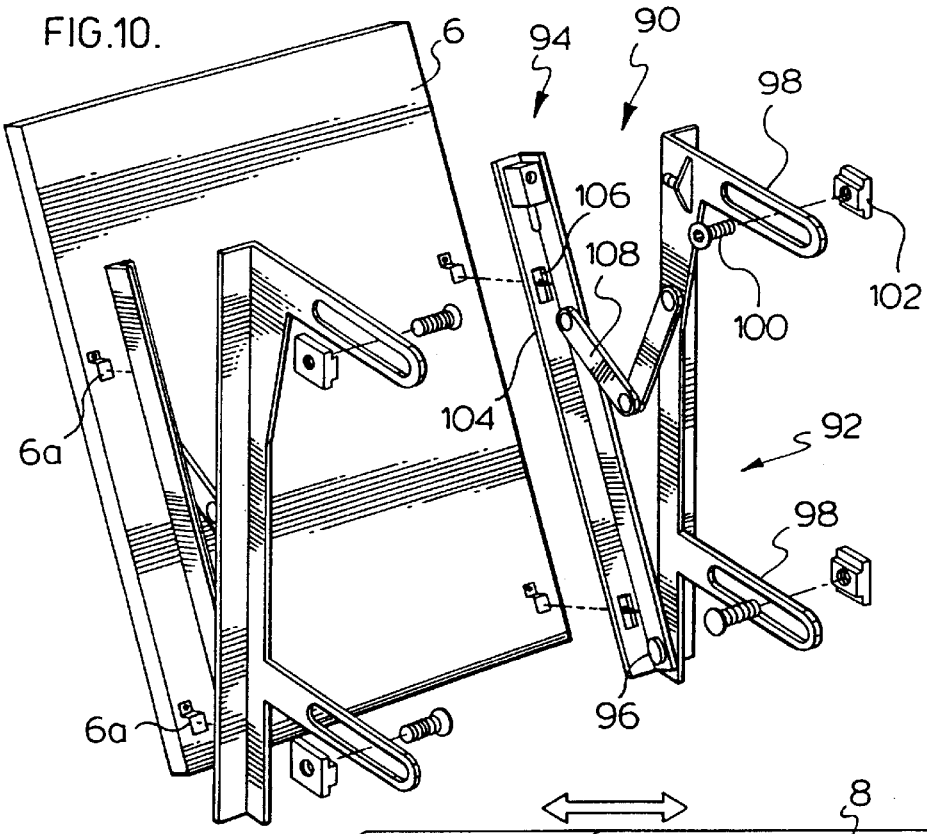
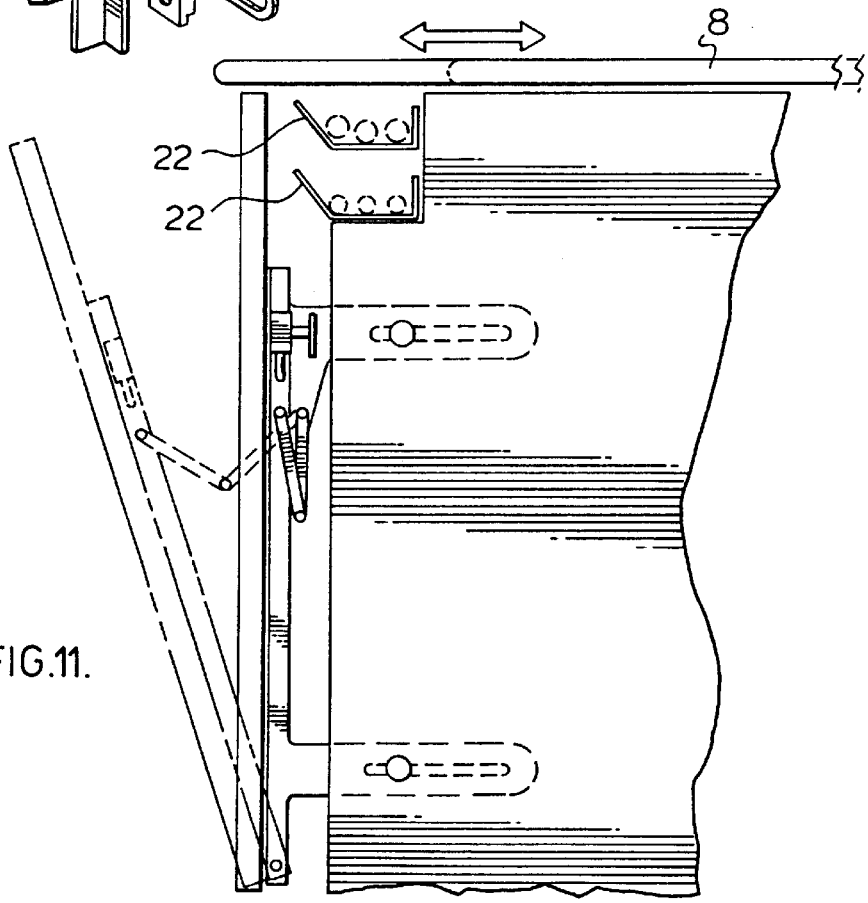
FIG.11.

COUNTERLINE SYSTEMS

This is a Continuation application of application Ser. No. 08/261,089 filed on Jun. 15, 1994, now U.S. Pat. No. 5,467,703, which is a continuation of application Ser. No. 07/796,788 filed on Nov. 25, 1991 now abandoned.

FIELD OF THE INVENTION

The present invention relates to a modular counterline or desking system.

BACKGROUND OF THE INVENTION

There are a host of businesses that provide service to a customer who deals across the counter with a service representative. The most well recognized counterline type systems are those used in banks, ticket counters, car rental counters, only to mention a few. These businesses have recognized that an effective counter system can assist them in providing service to the customer as well as contributing to the overall image of the company.

Banks, in particular, have recognized the need to be flexible with respect to their counterline to reflect changes in demographics of the area in which they serve as well as the times. In the past, most counterlines have been considered permanent, or at least did not readily accommodate changes in layout and configuration and, in most cases, were difficult to modify to the overall look and/or feel of the system. In many cases, the cost to change a system outweighed the perceived benefits and, therefore, the same image was maintained.

There remains a need to provide a flexible counterline system which can accommodate changes in configuration and can be broken down into individual modules, should changes and/or changes in location be necessary.

SUMMARY OF THE INVENTION

A counterline system, according to the present invention, comprises a series of individual modules which are adapted to be horizontally shiftable from an aligned position to a forwardly offset overlapping position to a rearwardly offset overlapping position. Each module includes a channel passageway across the module and side channel passageways extending to the front and extending at least partially along the sides of the module whereby wiring may be placed in the channel passageways to interconnect one module to adjacent modules.

According to an aspect of the invention, the counterline includes a counter top and a counter front wherein at least one of the counter top and the counter front are movable to an open position exposing the channel passageway and any wires or lines therein.

According to a further aspect of the invention, the channel passageway, in the open position of at least one of the counter top and counter front, allows wires and lines to be laid in place in the channel passageways without threading through ports in the counterline.

A counterline module, according to the present invention, comprises opposed side frames interconnected at a front edge by at least one channel member. The side frames include a side passage adapted to be closed along a side portion by either a cover secured to said side frame, or an aligned side frame or a combination of an aligned side frame and a cover.

According to an aspect of the invention, the counterline module has at least two side passages in each side frame open adjacent the front of the side frame to cooperate with the channel member. One of the side passages is at the approximate height of the channel member and the other passage being lower than the channel member whereby the wire can pass to the adjacent module at different heights.

According to yet a further aspect of the invention, the counterline module includes a vertically open space between the end of the channel and the front end of the side passages for accommodating wires passing from the channel to one of the passages.

BRIEF DESCRIPTION OF THE DRAWINGS

Preferred embodiments of the invention are shown in the drawings, wherein:

FIG. 10 shows a particular structure for securement of a counterline front to a hinged support network secured to the front of the counterline module frame;

FIG. 11 is a side view showing the pivotted counter front of FIG. 10 secured to a counterline module frame.

DETAILED DESCRIPTION OF THE PREFERRED EMBODIMENTS

Figure 1:
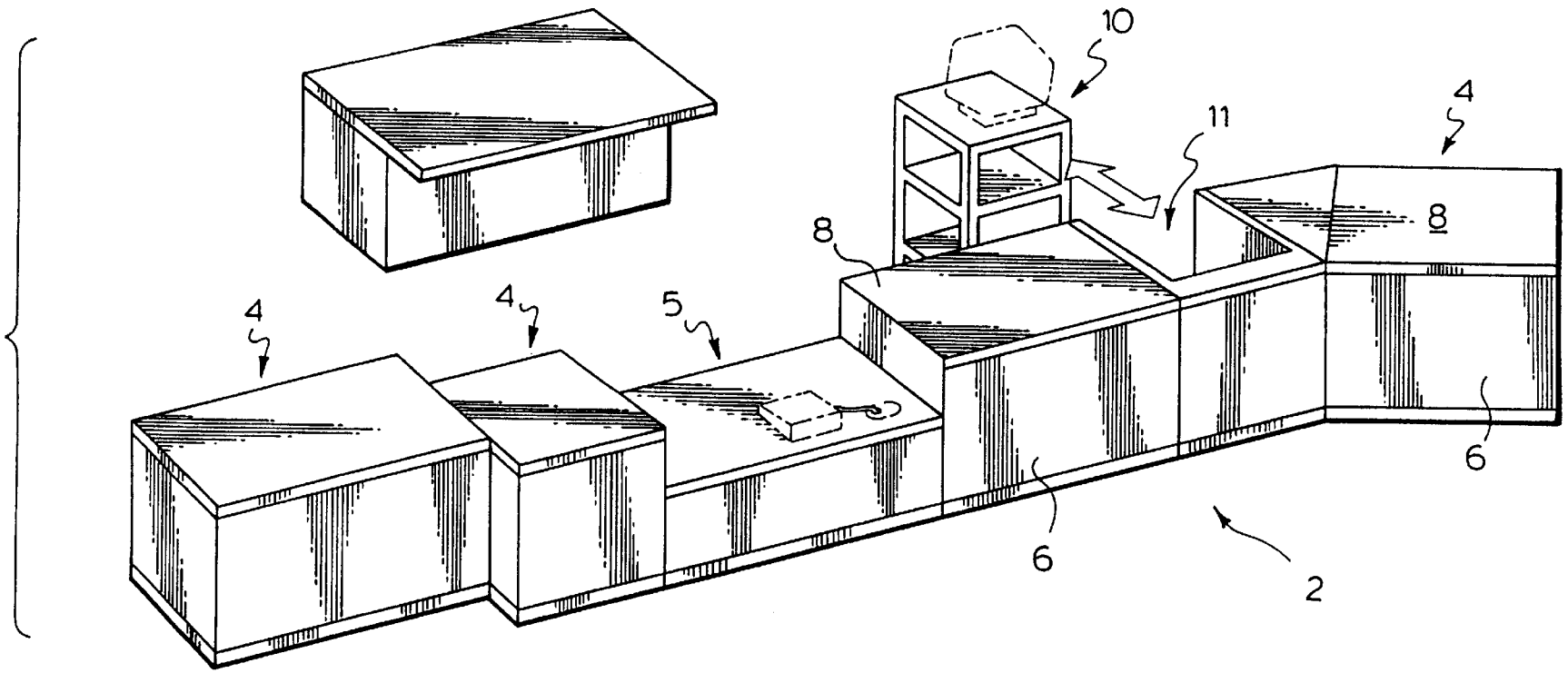
FIG. 1 is a perspective view of a number of counterline modules interconnected to form a counterline.

The modular counterline 2, shown in FIG. 1, is made up of separate modules 4 which are structurally interconnected. Each module includes a top 8 and a front panel 6. Various side panels or partial side panel covers can be used, depending upon the exact configuration of the counterline and the number of modules which are offset to provide a stepped type counterline. Each module 4 need not have a continuous top portion and the top portion may merely be a recess 11, as indicated in FIG. 1, for receiving the movable cart 10. The individual modules may be offset to provide a stepped type counterline as well as to accommodate variations in height for different types of service. For example, in FIG. 1, a desk module 5 is shown near one end of the counterline which would be suitable for taking information from customers who would be sitting on chairs on the opposite side of the desk. In contrast, the other modules shown would be more appropriate for dealing with customers who are standing.

Figure 2:
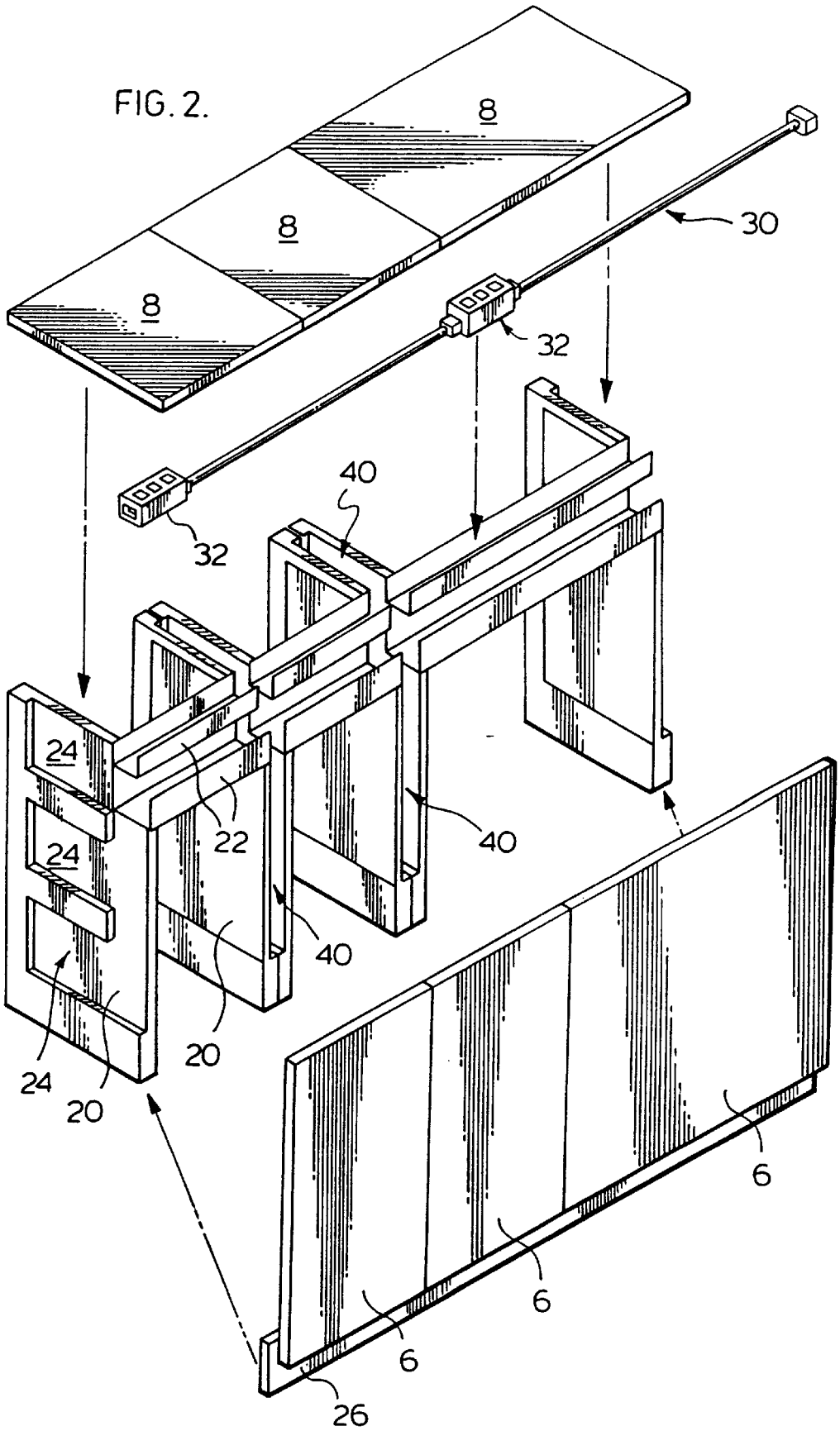
FIG. 2 is an exploded perspective view showing various components of the counterline and counterline modules.

Further details of the modular counterline system are shown in FIG. 2. Each of the modules 4 shown include opposed side frames 20 which are mechanically connected adjacent the front edge of the panels by connecting channels 22. The connecting channels not only provide mechanical interconnection of the opposed side frames 20, the channels also accommodate and support the passage of wires across the front edge of the counterline. Side passages 24 are provided in each of the side frames 20 and when two side frames are brought into abutment, as generally shown in FIG. 2, there is an open space 40 through which wiring may be laid. This is of particular advantage to accommodate the horizontal shifting of the modules to produce a stepped counterline. In this case, passages 24 provide the necessary passageway for allowing cables and wires and the like to pass from the channels 22 to the channels 22 of adjacent modules which may be horizontally offset. In addition, because of the various channels 24 provided in the side frames 20, changes in height of connecting channels 22 of adjacent frames is also accommodated. As can be seen, when the panels are aligned as shown in FIG. 2, the wiring harness 30 may be inserted within these channels. Preferably, the wiring harness has a number of duplex receptacles 32 which will be available for powering of any equipment on top of the modular tops 8. Secured to the front of the opposed side frames 20 of each module are the module front panels 6. In addition, a baseboard members 26 are secured to the lower portion of each module.

The modular front panels 6 can be releasably secured to the front of the side frames or can be permanently secured. In some banking installations these panels might be bulletproof and be secured to the counterline in a manner not releasable from the front of the counterline. In other counters these may merely serve a decorative purpose and be releasably secured in any convenient manner.

Figure 3:
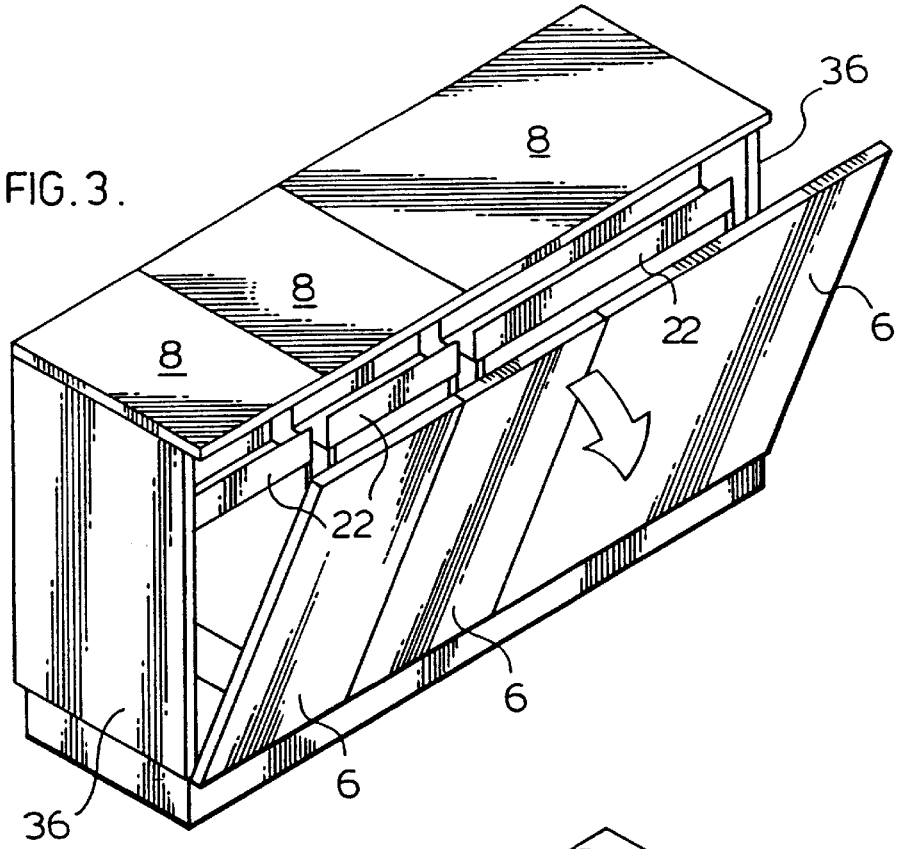
FIG. 3 is a partial perspective view of a portion of a counterline having the front covers pivotal about their lower edge to allow access to the channels of the counterline modules.
Figure 4:
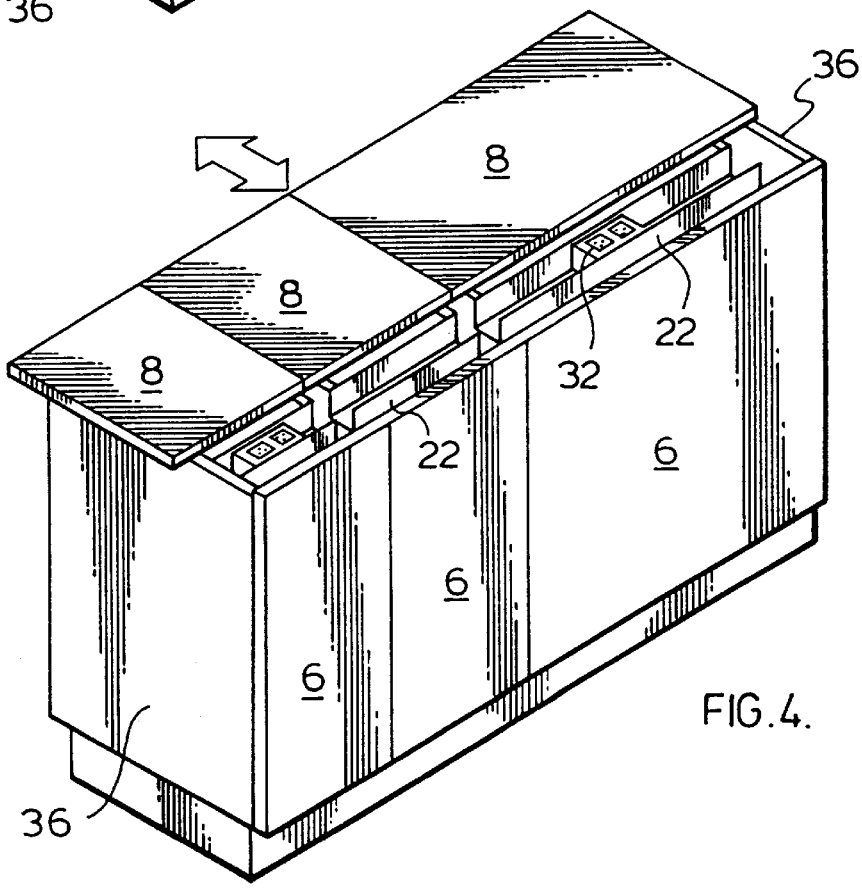
FIG. 4 is a partial perspective view showing counterline tops movable to an open position, exposing the channels of the individual modules.

FIGS. 3 and 4 demonstrate two different arrangements for allowing access to the connecting channels 22. In FIG. 3, the bottom edge of the modular front panel 6 is hingedly secured to the side frames and can pivot outwardly to expose the channels therebehind. In this way, an electrician or other personnel seeking to rewire the counterline or bring in additional lines can have full access to the channels. In FIG. 3, each end of the modular counterline has been provided with a decorative end cover 36 which closes the channel and basically provides a finished end surface.

In the embodiment of FIG. 4, the modular tops 8 can each independently slide rearwardly to expose the channels 22. This, again, allows the electrician or installer access to these channels and simplifies wiring and/or modification of the powering of the counterline. Furthermore, the movable modular tops 8 shown in FIG. 4, or the hinged front panels 6 of FIG. 3, can allow the user access to the channels and access to the power receptacles 32. In this way, a cord can pass through a port provided in the modular top 8 and be connected to one of the duplex receptacles 32.

Figure 5:
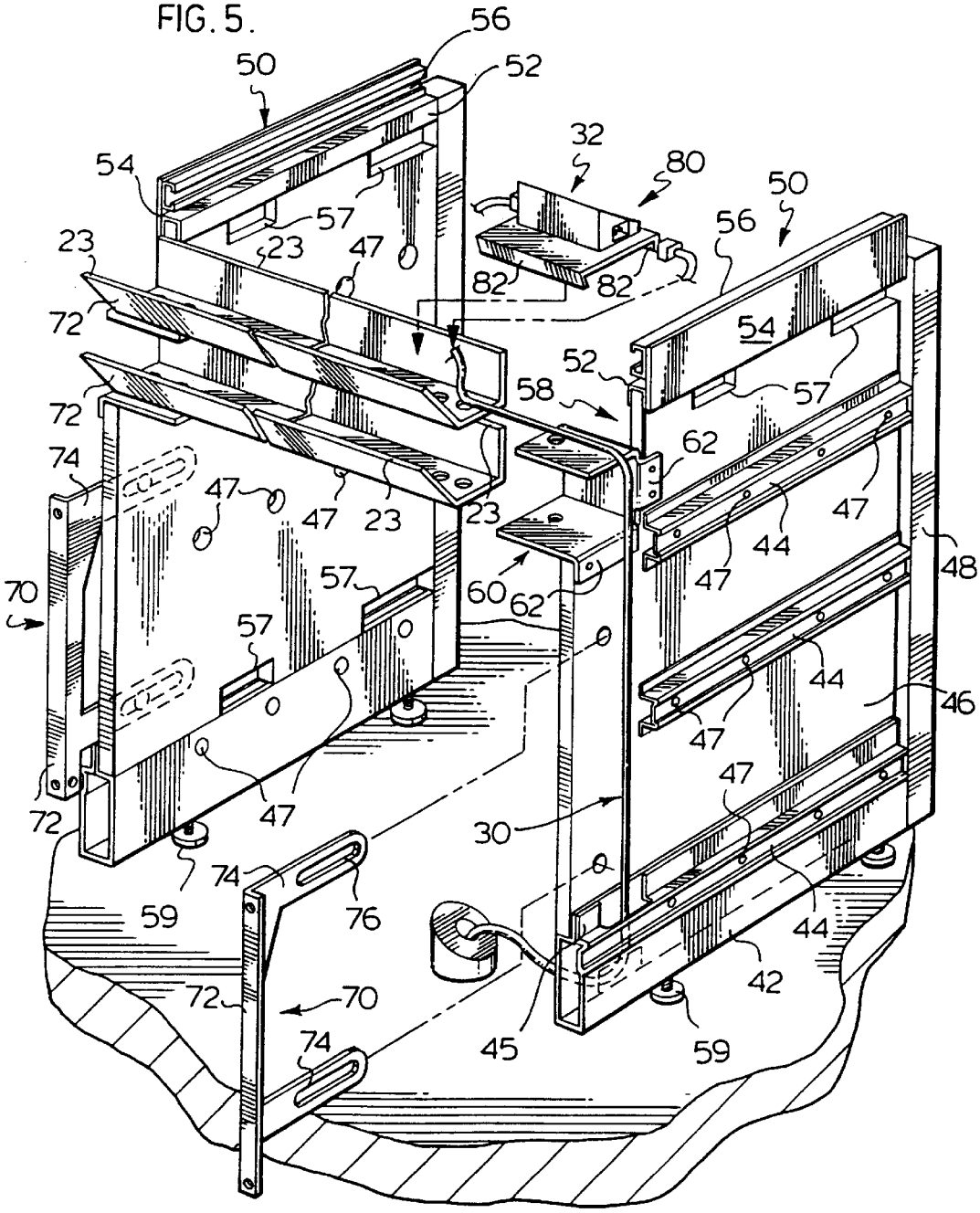
FIG. 5 is a perspective view of one counterline module without the decorative covers applied thereto.

Details of one module 4 are shown in FIG. 5. Each side frame 20 includes a base rail 42 preferably made of steel. This base member engages the adjusting feet 59 used to level the particular side frame. To the inside face of the side frame 20, a structural substrate 46 is engaged by a flange 45 atop the base rail 42. This structural substrate is preferably of wood and includes a number of securing ports 47 spaced in the structural substrate 46 and used to engage adjacent side frames. To the exterior surface of the structural support 46 are a number of spacing and reinforcing rails 44. These rails align with the ports 47 provided in the structural substrate 46 and will allow passage of a mechanical securing member, such as a bolt, through the structural support and through the spacing and reinforcing rail 44.

In FIG. 5, two separate rails are shown intermediate the height of the structural substrate 46, with these rails being generally horizontal. The rails stop short of the connecting channels 22 at the front edge and allow wires to be located between these rails for interlinking with an adjacent vertical channel which can be at a different height. The clear vertical space in front of the rails accommodate any vertical transitions of the wires between modules. This linking and use of the space between the rails is required when the modules are horizontally offset to provide the stepped counterline configuration.

A rear vertical member 48 is secured to the base 42 and also engages the structural substrate 46. At the upper edge of the side frame 20 is a U-shaped channel 52 engaging the upper edge of the structural substrate and secured thereto. A plate 54 extends above the U-shaped channel and supports in a horizontal manner the track 56 which will slidingly engage a modular top 8. As can be seen in the Figure, the structural substrate 46 has been notched at the front top edge to receive the connecting channels 22 secured to a structural support member by bracket 60, having flanges 62 secured to the structural substrate 46. Brackets 60 interconnect the channels to the substrate 46. Each substrate 46 has been provided with securing ports 57 which are used to allow fastening of the finished side panels to the side frames.

Various methods for securing of components to the module 4 are shown in FIG. 5. A power outlet mounting plate 80 having downwardly extending flanges 82 is provided and can be moved along and is supported by the upper edges 23 of the upper connecting channel 22. Secured to this power outlet mounting plate is a power outlet 32 having the various receptacles centered therein. This power outlet 32 is connected to the wiring harness 30.

Front bracket 70 includes a face portion 72 for securing the front cover 6 in FIG. 1. Securing arms 74 of the front bracket 70 extend rearwardly and are secured to the structural substrate 46 by means of the securing port 47 and appropriate mechanical fasteners. The slots 76 in the front bracket 70 accommodate the desired positioning of the front panel the required distance in front of the opposed frames 20.

Figure 6:
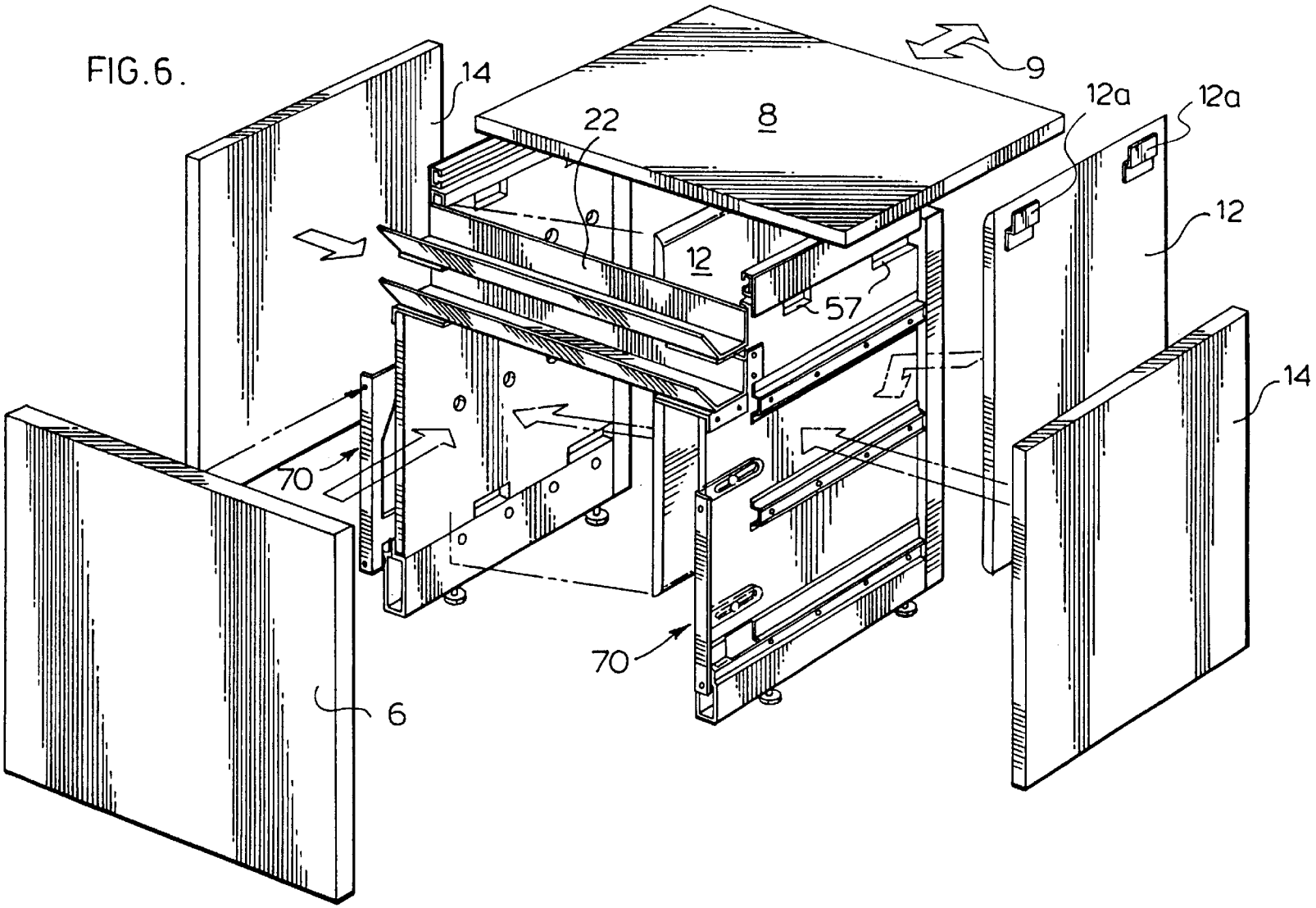
FIG. 6 is an exploded perspective view showing securement of the various finished surfaces to a counterline module frame.

As can be seen from FIG. 5, the side frames 20 and the connecting channels 22 are designed to be structurally strong and accommodate the transmission of wiring harnesses between adjacent modules. The units have inherent strength and little attention has been given to the cosmetics of the panels. The look of the system is enhanced by securing of finished panels and finished surfaces to the side frames and connecting panels. Details of this are shown in FIG. 6. In this case, the front panel 6 is secured to the front brackets 70 by suitable fasteners passing through the front brackets 70 and entering the front panel 6. The interior side panels include top brackets 12*a* which are received in the upper securing ports 57 of the structural substrate 46. Two similar brackets are provided adjacent the bottom of the panel and will engage the lower ports 57. The placement of the brackets 12*a* and the lower brackets are such that the top brackets 12*a* are inserted into the ports and the panel is slid upwardly to a position allowing the lower brackets to be received in the lower ports 57 and the panel can then drop into proper location and be locked by the brackets to the opposed side frames. Exterior side panels 14 are preferably secured to the structural substrate 46 by mechanical fasteners passing through port 47 and engaging the exterior panels 14. The modular top 8 includes a ball bearing type roller arrangement engaging the track 56 and accommodating limited movement of the top in the direction of arrow 9. This will allow the channels 22 to be accessible.

Figure 7:
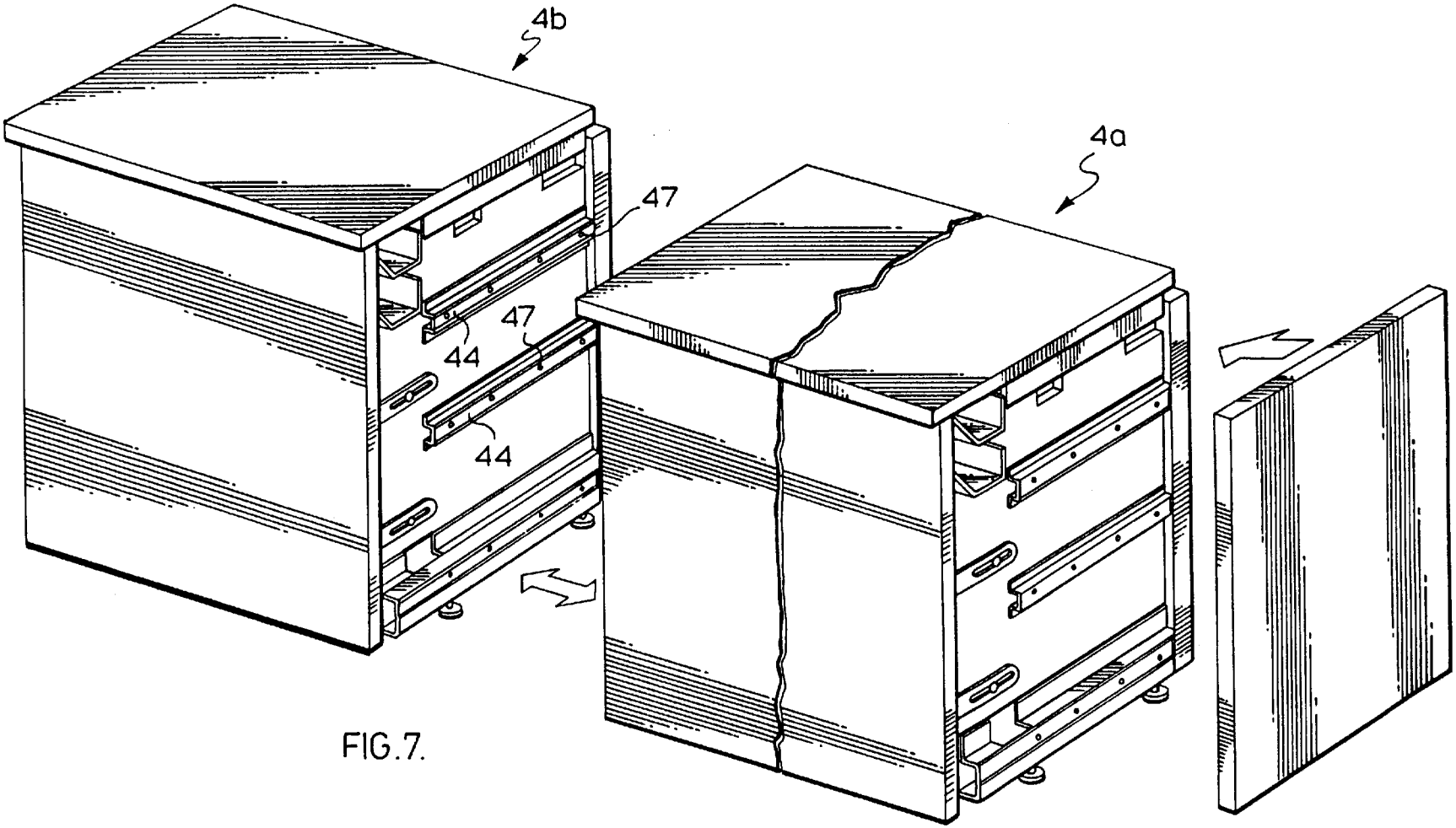
FIG. 7 is a perspective view showing how counterline modules may be interconnected.

FIG. 7 shows two modules 4*a* and 4*b* being brought into engagement for securing together. The modules are secured by mechanical fasteners passing through a number of aligned ports 47 provided in the spacing and reinforcing rails 44. As can be seen, the securing ports 47 are spaced at particular intervals in the length of the spacing and reinforcing rails 47 which correspond with fixed increments of offset that the modular panels are designed to be used at. Thus, the modules can be directly connected, as shown in FIG. 7, or could be offset in increments corresponding to the spacing of the securing ports 47 provided in each of the spacing and reinforcing rails 44. The mechanical securing will be accomplished by fasteners passing through the structural substrate 46 of module 4*b* and into the structural substrate 46 of module 4*a*. The mechanical fastener is preferably a flush type connection with the mechanical securing being interior to the two modules. A very strong mechanical connection can be made due to the fastener passing through not only the spacing and reinforcing rails 46 which abut, but also through the structural substrates 46. It is apparent that when the side frames are directly opposed and aligned, there would be no cover members, as the interior between these two frames is used as the passageway. If there is an offset between the two modules, a partial cover would be used to cover the portion of the side frame of each module exposed beyond the other module.

Figure 8:
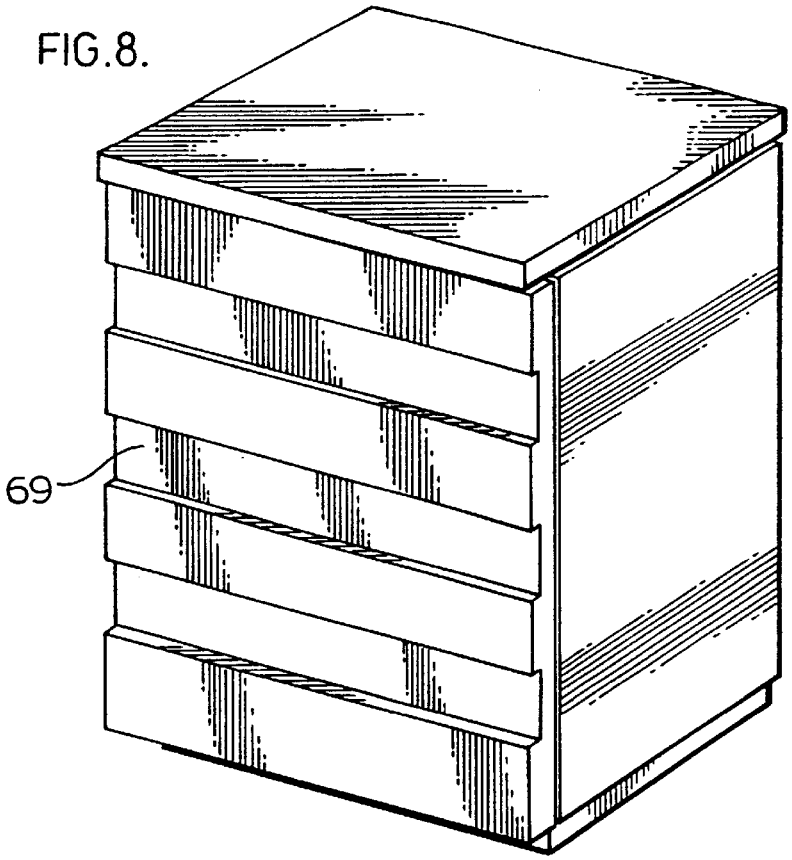
FIG. 8 is a front view of a particular counterline module.
Figure 9:
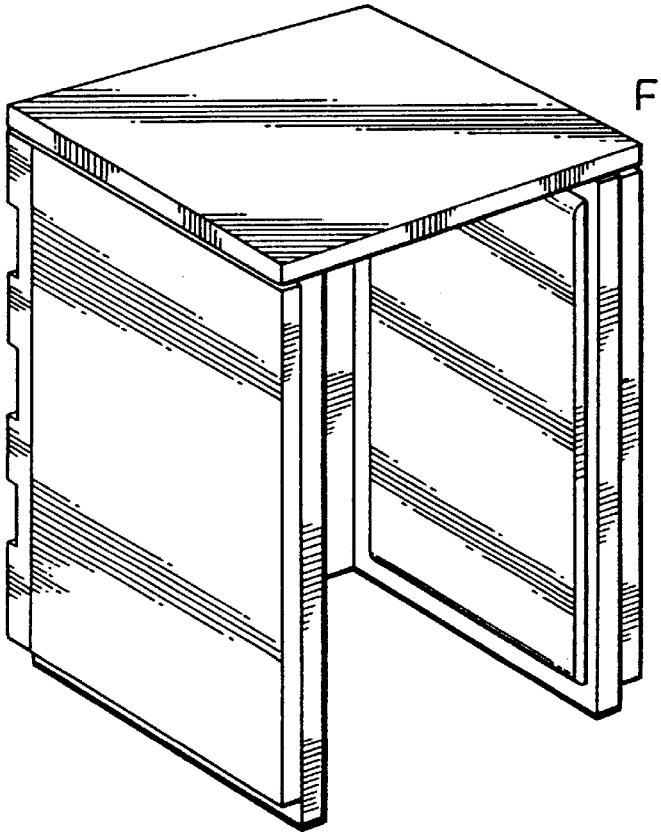
FIG. 9 is a perspective rear view of the counterline module of FIG. 8.

A single finished module is shown in FIGS. 8 and 9, although this would be an unusual occurrence, as the modules are designed to interconnect to form a counter or work surface. The normal practice for a module would be to be connected to an adjacent module and, at most, would have one of these side frames with a finished panel secured thereto completely covering side frame. It can be appreciated that in an offset arrangement, partial covers might be used. In any event, it can be seen that quite a different configuration or look of the module can be accomplished by using a different front module panel 6*a*. In this case, a recessed type panel is used giving a completely different look relative to the earlier flush faced panels of FIG. 1. These panels need not be a wood finish, they could be a cloth finish or a metallic finish, or any desired finish which is appropriate for the image of the company. Thus, it can be seen that although the panels are replaced to present a new look, the structural support framework remains and thus, the costs for producing a new counterline will be reduced.

FIGS. 10 and 11 illustrate an arrangement for accommodating the forward hinging of the front panel 6*a*. In this case, a special bracket arrangement 90 is shown having a side frame engaging portion 92 and a panel engaging portion 94. The panel engaging portion 94 is pivotally secured at 96 to the frame engaging portion 92. The frame engaging portion 92 includes securing arms 98 extending rearwardly for engaging the side frames 20 and a bolt 100 is adapted to engage a nut type member 102 slidably received within the structural substrate of the particular side frame. The panel engaging portion 94 includes a front face 104 for supporting the front panel 6 which has been provided with brackets 6*a* on the interior surface for receipt within slots 106 provided in the front face 104. The brackets pass through the slots and the panel is then slid downwardly to a locked and finished position. The linkage 108 serves to limit the extent to which the front panel 6 may be pivotted outwardly about the pivot point 96. The device is shown in FIG. 11 secured to side frames and is movable from the closed position, shown in solid lines, to the dotted position where access to the connecting channels 22 is possible. It can also be seen that the top module 8 can move rearwardly to expose the vertical channels. Although both a movable front face and a movable top is shown in FIG. 11, in most cases only one of these arrangements for providing access to the channels 22 would be used. It can also be appreciated that the channels 22 can be positioned somewhat lower than the position shown in FIG. 11 in the case where only the front panel moves outwardly to expose the channels. A little additional clearance would simplify inserting of wires or the like in the top channel 22.

Figure 12:
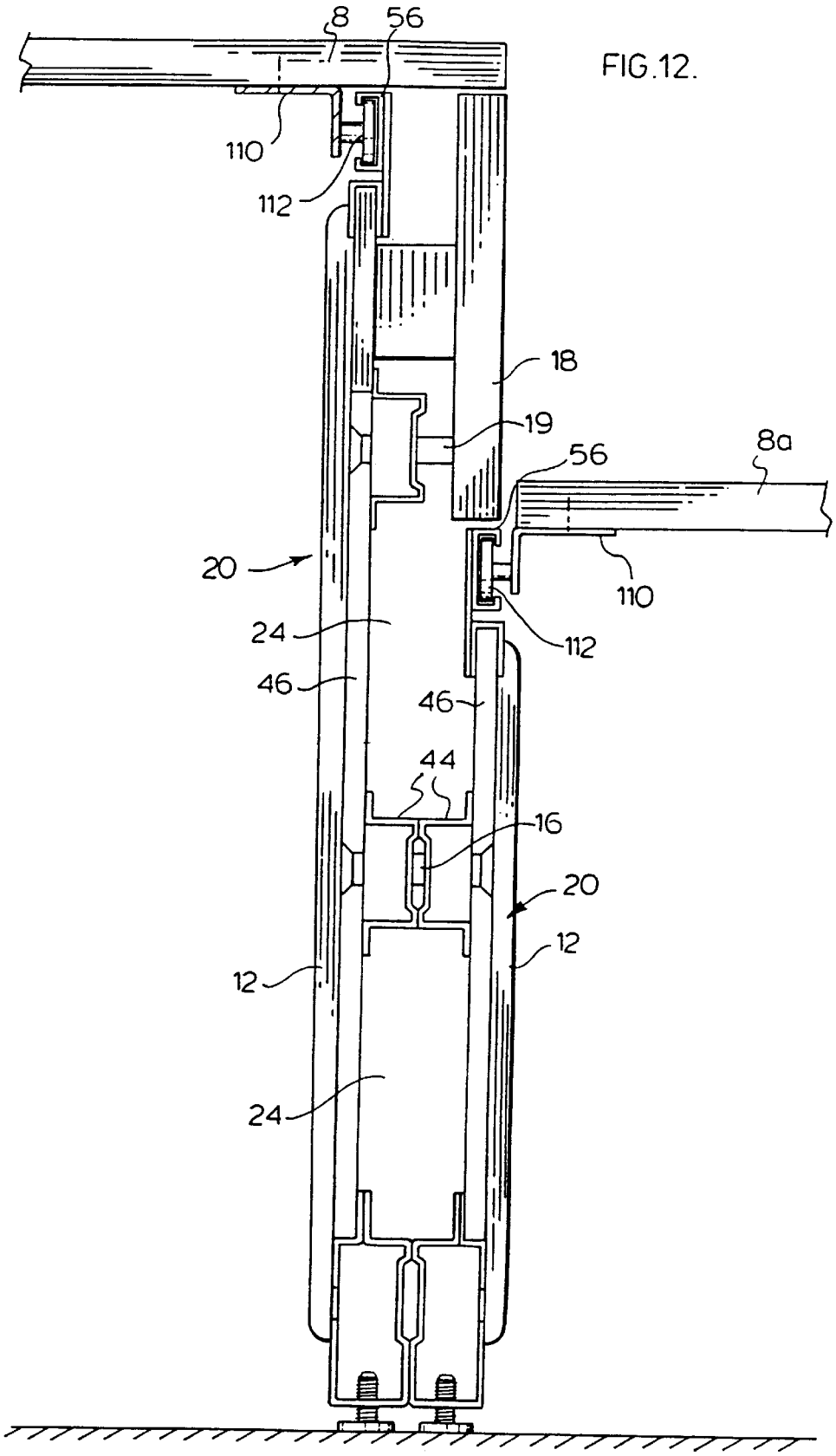
FIG. 12 is a sectional view showing two secured side frames of two modules and the various passageways for allowing wires to pass between counterline modules.

A sectional view through two adjacent secured opposed side frames 20 is shown in FIG. 12. In this case, the finished height of the modular top 8 is different. The side frames each include finished interior side panels 12 which cover the structural substrate 46 of each side frame. The side frames are secured together by a mechanical fastener 16 passing between the two structural substrates 46 and through two opposed spacing and side rails 44. There is a portion of the one larger side frame which would be exposed above the finished top 8*a* of FIG. 12. In this case, a short trim panel 18 is secured to the side frame and typically will be secured by a fastener 19 passing through the structural substrate 46. The tops 8 and 8*a* each include a bracket 110 supporting a roller arrangement 112 which has limited movement within the track 56 of each of the opposed side frames 20.

FIG. 12 also illustrate the clear passageways 24 which are open at the front of the space and reinforcing rails 44 to allow passage of wires and the like rearwardly or forwardly in the space between rails to accommodate offsets in adjacent modules 4.

The opposed side frames 20 have been described with respect to a particular construction which is of a composite nature including a wooden member engaging various steel members positioned at various points. It is within the scope of the invention merely to provide a steel type framework while still utilizing the passageways between the spacing and reinforcing rails 44. Although the structural substrate is shown as one continuous sheet, this can be replaced by spaced vertical members, for example, and possibly made from different materials. Therefore, the structural substrate could be a structural framework.

The modular frame is also shown as connected adjacent the top edge by the connecting channels 22. A structural brace can be provided between opposing side frames defining a module to further increase the structural stability of the system. Such a brace could be adjacent the lower edge of the side frames.

It can be appreciated that with the modular system described, the counterline can be customized to accommodate the particular requirements of the user. The front panels can easily be changed and various types of finishes can be provided for significantly changing the feel and look of the system. Special requirements, such as bulletproof partitions, etc. can also be accommodated with this system.

The counter tops have been shown as being flat, however, in fact, they can include raised portions which also move with the counter top. The counter top can also be customized and various levels can be provided thereon.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A counterline comprising a series of individual modules with each module having opposed rectangular side frames structurally interconnected adjacent a front face thereof, at least one upwardly opening channel member located adjacent a front of said counterline and fixed to each side frame in an open notch thereof, with side frames of adjacent modules being mechanically secured one to the other in a desired orientation of said counterline; each module including a work surface supported by said opposed side frames and sized to abut with a work surface of an adjacent module and provide a continuous work surface therebetween, each module including a front cover panel closing the front of each module between said side frames and locating said at least one channel behind said front cover panel and below said work surface, and wherein at least one of said work surfaces and said front cover panel of each module is mounted to be movable between a closed position where access to said at least one channel is restricted to an open position allowing access to said at least one channel such that wiring, cable and the like can be placed in and removed from said channel.

2. A counterline as claimed in claim 1, wherein said cover panel is hinged at a base of the module for limited pivotting movement outwardly exposing said at least one channel to allow access thereto.

3. A counterline as claimed in claim 1, wherein said work surface of each module is movable rearwardly to an access position where said at least one channel of said module is exposed whereby wires and the like may be placed therein and extend along the length of the counterline in said channels.

4. A counterline as claimed in claim 1 wherein each module includes at least two vertically spaced channels which extend across the front of said module.

5. A counterline as claimed in claim 1 wherein said at least one channel of each module extends essentially fully across the module and cooperates with channels of adjacent modules to provide a continuous channel along the front face of the counterline.

6. A counterline as claimed in claim 5 including a mounting arrangement for said front cover which hinges said front cover along the base thereof for pivotting movement of the cover outwardly away from said counterline exposing said at least one channel for access thereto.

7. A counterline comprising a series of individual modules with each module having opposed side frames interconnected by at least one upwardly opening channel member located adjacent a front of said counterline, each module including a working surface supported by said opposed side frames and extending across said module abutting with and forming a continuous work surface with an adjacent module, each module including a front cover panel providing a finish front to each module extending from about ground level to the level of the work surface and said cover panels collectively providing a finish face to said counterline, each front cover panel being mounted for convenient movement to a service position where said at least one upwardly opening channel member is exposed allowing fast access to any wires cables or the like contained in said upwardly opening channel member.

8. A counterline as claimed in claim 7 wherein said front cover panels are pivotally secured to said opposed side frames adjacent a lower edge of said front cover panels and pivot outwardly away from said counterline when moved to said service position.

9. A counterline as claimed in claim 7 wherein side frames of adjacent modules are mechanically fastened one to the other.

10. A counterline as claimed in claim 7 wherein each side frame is notched to receive said at least one channel with said side frame providing a vertical support surface for said front cover below said channel.

11. A counterline as claimed in claim 10 wherein each module includes two channels positioned one above the other at an upper portion of said side frames.

* * * * *